US009735551B2

(12) United States Patent
Jung et al.

(10) Patent No.: US 9,735,551 B2
(45) Date of Patent: Aug. 15, 2017

(54) SURGE ABSORBER AND MANUFACTURING METHOD THEREOF

(71) Applicant: SMART ELECTRONICS INC., Ulsan (KR)

(72) Inventors: Jong il Jung, Busan (KR); Doo Won Kang, Anyang-si (KR); Gyu Jin Ahn, Ulsan (KR); Sang Joon Jin, Busan (KR); Hyun Chang Kim, Ulsan (KR); Kyung Mi Lee, Ulsan (KR); Dong Ho Jeon, Busan (KR); Dong Jin Kang, Ulsan (KR)

(73) Assignee: SMART ELECTRONICS INC., Ulsan (KR)

( * ) Notice: Subject to any disclaimer, the term of this patent is extended or adjusted under 35 U.S.C. 154(b) by 72 days.

(21) Appl. No.: 14/441,838

(22) PCT Filed: Nov. 11, 2013

(86) PCT No.: PCT/KR2013/010167

§ 371 (c)(1),
(2) Date: May 9, 2015

(87) PCT Pub. No.: WO2014/073918

PCT Pub. Date: May 15, 2014

(65) Prior Publication Data

US 2015/0303657 A1 Oct. 22, 2015

(30) Foreign Application Priority Data

Nov. 9, 2012 (KR) ..... 10-2012-0126416

(51) Int. Cl.
*H01T 4/02* (2006.01)
*H01T 4/04* (2006.01)
(Continued)

(52) U.S. Cl.
CPC ..... *H01T 4/02* (2013.01); *H01T 4/04* (2013.01); *H01T 4/12* (2013.01); *H01T 21/00* (2013.01)

(58) Field of Classification Search
CPC ... H01T 4/00–4/20; H01C 1/02; H01C 1/024; H01C 1/026; H01C 7/12; H02H 9/04–9/042; H02H 9/044
See application file for complete search history.

(56) References Cited

U.S. PATENT DOCUMENTS 4,156,886 A * 5/1979 Jones ..... H01T 4/12 313/306
7,389,834 B1 * 6/2008 Kembaiyan ..... B23K 35/3006 175/435
7,660,095 B2 * 2/2010 Shato ..... H01T 4/12 361/120

FOREIGN PATENT DOCUMENTS

CN 101015101 A 8/2007
JP H09-092428 A 4/1997
(Continued)

*Primary Examiner* — Stephen W Jackson
*Assistant Examiner* — Christopher Clark
(74) *Attorney, Agent, or Firm* — Novick, Kim & Lee, PLLC; Jae Youn Kim

(57) ABSTRACT

A surge absorber and a manufacturing method thereof are disclosed. Since a ceramic material with excellent mechanical strength is used to form a ceramic tube and the ceramic tube is joined to sealing electrodes by use of brazing rings according to the method of manufacturing the surge absorber, durability of the surge absorber is considerably improved. Since the ceramic tube is completely sealed, the surge absorber may be stably used at a high voltage.

11 Claims, 10 Drawing Sheets

(51) Int. Cl.
*H01T 4/12* (2006.01)
*H01T 21/00* (2006.01)

(56) References Cited

FOREIGN PATENT DOCUMENTS

| | | | |
|---|---|---|---|
| JP | H09-266052 | A | 10/1997 |
| JP | 10-22042 | A | 1/1998 |
| JP | 2006-286251 | A | 10/2006 |
| KR | 10-2007-0034097 | A | 3/2007 |
| KR | 10-2012-0097135 | A | 9/2012 |
| KR | 10-2014-0031501 | A | 3/2014 |

* cited by examiner (a)

(b)

SURGE ABSORBER AND MANUFACTURING METHOD THEREOF

BACKGROUND OF THE INVENTION

Field of the Invention

The present invention relates to a surge absorber and a manufacturing method thereof, and more particularly, to a surge absorber having improved durability, since a ceramic tube formed of a ceramic material with excellent mechanical strength is used and the ceramic tube is joined to sealing electrodes by use of brazing rings, and stably used at a high voltage, since the ceramic tube is completely sealed, and a manufacturing method thereof.

Description of the Related Art

In general, a surge absorber is a device mounted on a region vulnerable to electric shock due to abnormal overvoltage such as lightning surge, static electricity, or the like to prevent a printed circuit board, on which electronic components are mounted, from being damaged due to abnormal overvoltage via discharge of gas that consumes discharge energy upon application of an abnormal voltage thereto. The surge absorber is installed at a junction between a transmission line and telecommunications terminal equipment such as telephones, facsimiles, and modems, or a driving circuit of display apparatuses such as TVs or monitors.

FIG. 10 is a sectional view illustrating a structure of a conventional surge absorber. Referring to FIG. 10, a surge absorber disclosed in Korean Patent Application Publication No. 2012-0097135 includes an accommodation tube 11 filled with an inert gas, a pair of sealing electrodes 12 disposed at both ends of the accommodation tube 11 and respectively electrically connected to lead wires 13, and a surge absorbing unit 15 electrically connected to the sealing electrodes 12. The surge absorbing unit 15 includes a nonconductive member 16, a conductive coating film 17 enclosing the nonconductive member 16, a protective film 18 protecting the conductive coating film 17 in a state of surrounding the conductive coating film 17, and a plurality of discharge gaps 19 dividing the conductive coating film 17 and the protective film 18.

However, in such a conventional surge absorber, a glass tube is used as the accommodation tube, and the glass tube is joined to the sealing electrodes by melting glass at a high temperature under the condition that the sealing electrodes are inserted into the accommodation tube, and thus sufficient joining strength cannot be obtained. In addition, a conventional surge absorber has insufficient durability due to low strength of the glass accommodation tube and low joining strength. Accordingly, the conventional surge absorber cannot be stably used at a high voltage.

SUMMARY OF THE INVENTION

Therefore, the present invention has been made in view of the above problems, and it is an object of the present invention to provide a surge absorber having improved durability and capable of completely sealing a ceramic tube since a ceramic tube formed of a ceramic material with excellent mechanical strength is used and the ceramic tube and each of the sealing electrodes are joined to each other by use of brazing rings, and a method of manufacturing the surge absorber.

It is another object of the present invention to provide a surge absorber capable of being stably used at a high voltage due to excellent sealing performance and improved durability, and a method of manufacturing the surge absorber.

It is a further object of the present invention to provide a surge absorber capable of improving wetting properties, joining strength, and discharge performance of brazing rings by forming a plating layer at brazing junction regions, and a method of manufacturing the surge absorber.

In accordance with the present invention, the above and other objects can be accomplished by the provision of a surge absorber including a ceramic tube filled with an inert gas, a pair of sealing electrodes disposed at both ends of the ceramic tube and respectively electrically connected to lead wires, a surge absorbing unit accommodated in the ceramic tube, electrically connected to the sealing electrodes, and having discharge gaps, and brazing rings sealing between the ceramic tube and each of the sealing electrodes. The ceramic tube is joined to the sealing electrodes by melting of the brazing rings.

The brazing ring may include an alloy including copper (Cu), silver (Ag), and zinc (Zn).

Each of the sealing electrodes may include a contact portion protruding toward the inside of the ceramic tube to be inserted into the ceramic tube and contact the surge absorbing unit and a junction portion joined to the brazing ring.

An outer surface of the brazing ring may be disposed at the same line of an outer surface of the ceramic tube, and an inner surface of the brazing ring may be disposed to extend toward the inside of the ceramic tube to a portion farther inward than an inner edge of the ceramic tube.

The brazing ring may include an outer circumferential portion joined to the ceramic tube and an inner circumferential portion joined to an end portion of the surge absorbing unit.

The surge absorber may further include brazing members melted between the contact portion and each of the terminal electrodes to join the contact portion to the terminal electrode.

The surge absorber may further include a plating layer comprising nickel (Ni) or titanium (Ti) disposed on at least one selected from the group consisting of the contact portion, the junction portion, and the terminal electrode to improve joining strength and discharge properties by melting of the brazing ring or the brazing member.

In accordance with an aspect of the present invention, the above and other objects can be accomplished by the provision of a method of manufacturing a surge absorber including preparing the first sealing electrode, sequentially stacking the first brazing ring and the ceramic tube on the first sealing electrode, inserting the surge absorbing unit into the ceramic tube, sequentially stacking the second brazing ring and the second sealing electrode on the ceramic tube, and sealing between the ceramic tube and each of the first and second sealing electrodes by placing the resultant structure in a chamber under an inert gas atmosphere and melting the first and second brazing rings. In this regard, the surge absorber includes a ceramic tube accommodating a surge absorbing unit, first and second sealing electrodes respectively inserted into both ends of the ceramic tube to be joined to the surge absorbing unit, and first and second brazing rings respectively joining the ceramic tube to each of the first and second sealing electrodes.

Each of the first and second sealing electrodes may include a contact portion protruding toward the inside of the ceramic tube to be inserted into the ceramic tube and contact the surge absorbing unit and a junction portion joined to each of the first and second brazing rings, and each of the first and second brazing rings may be inserted to the junction portion of each of the first and second sealing electrodes.

The first and second brazing rings may be formed of $Ag_{25}Cu$, an alloy having a surface provided with copper (Cu) and silver (Ag), and the sealing may be performed by melting the first and second brazing rings at a temperature of 800 to 850° C.

The first and second brazing rings may be formed of $Ag_{56}CuZnSn$, an alloy including silver (Ag), copper (Cu), zinc (Zn), and tin (Sn), and the sealing may be performed by melting the first and second brazing rings at a temperature of 600 to 650° C.

A plating layer including nickel (Ni) or titanium (Ti) may further be formed on the surface of the junction portion to improve joining strength and discharge performance by melting of the first and second brazing rings.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, the present invention will be described with reference to the accompanying drawings.

When it is determined that a detailed description of the related art may unnecessarily obscure the subject matter of the present invention, the description thereof will be omitted. Further, the following terms, which are defined in consideration of functions of the present invention, may be altered depending on the user's intentions or judicial precedents. Therefore, the meaning of each term should be interpreted based on the entire disclosure of the specification.

Figure 1A:
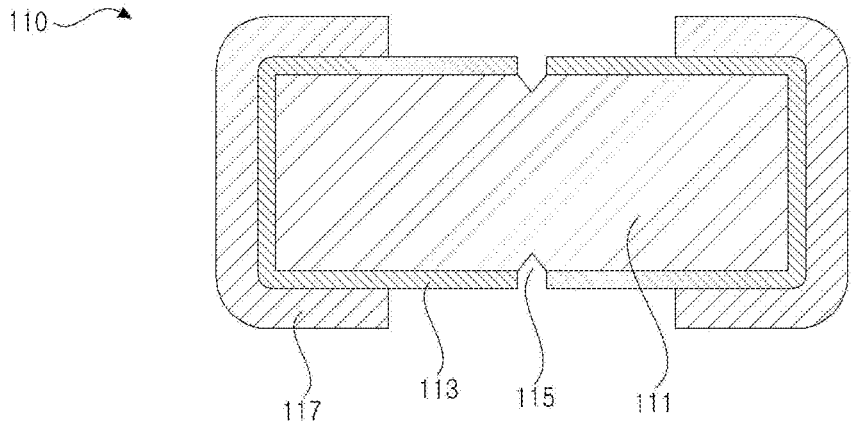
FIGS. 1A and 1B are sectional views illustrating surge absorbing units according to the present invention.
Figure 1B:
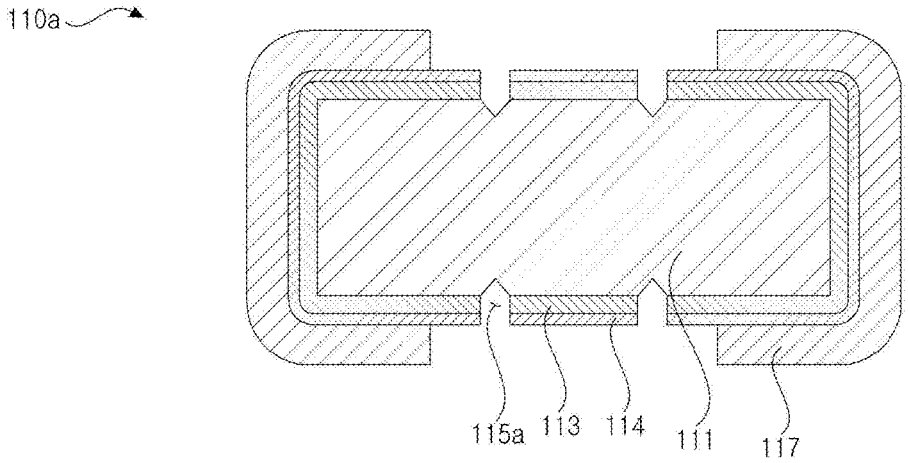
Figure 2:
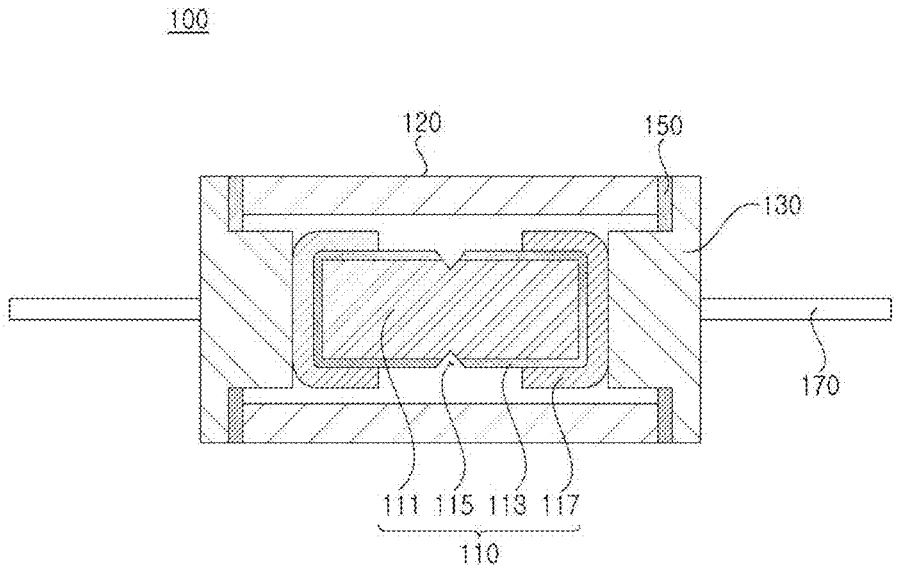
FIG. 2 is a sectional view illustrating a surge absorber according to a first embodiment of the present invention.
Figure 3:
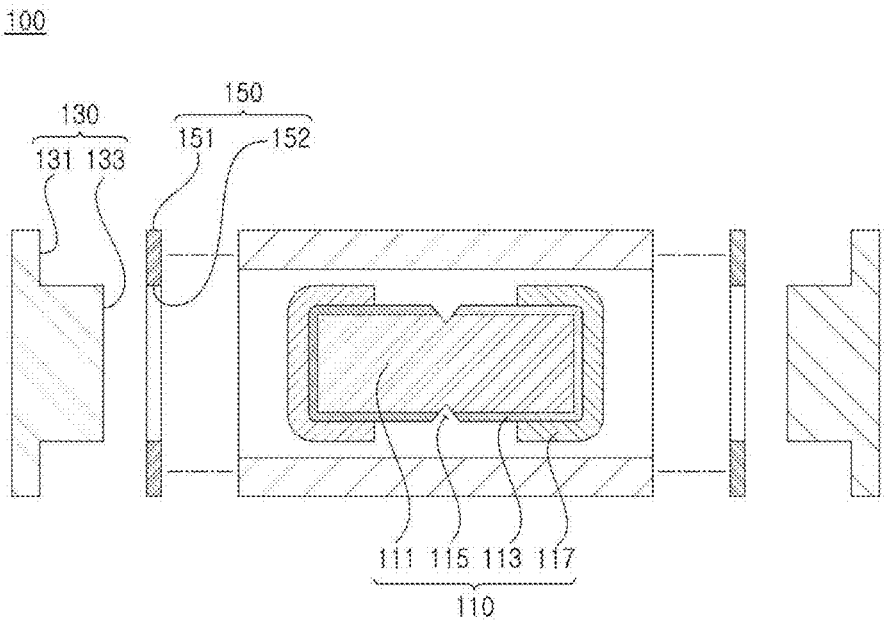
FIG. 3 is an exploded sectional view illustrating the surge absorber according to the first embodiment of the present invention.

FIGS. 1A and 1B are sectional views illustrating surge absorbing units according to the present invention. FIG. 2 is a sectional view illustrating a surge absorber according to a first embodiment of the present invention. FIG. 3 is an exploded sectional view illustrating the surge absorber according to the first embodiment of the present invention.

As illustrated in FIGS. 1A to 3, a surge absorber 100 according to the present invention generally includes a ceramic tube 120, sealing electrodes 130, a surge absorbing unit 110, and brazing rings 150.

Specifically, the surge absorber 100 according to the present invention includes a ceramic tube 120 filled with an inert gas, a pair of sealing electrodes 130, which are disposed at both ends of the ceramic tube 120 and respectively electrically connected to lead wires 170, a_surge absorbing unit 110, which is accommodated in the ceramic tube 120, is electrically connected to the sealing electrodes 130, and has discharge gaps 115, and brazing rings 150 which seal between the ceramic tube 120 and each of the sealing electrodes 130.

Referring to FIG. 1A, the surge absorbing unit 110 according to the present invention may include a nonconductive member 111, a conductive coating film 113, which encloses the nonconductive member, the discharge gaps 115, which divide the conductive coating film 113 at the center of the conductive coating film 113 to allow the conductive coating film 113 to be used as a discharge electrode, and terminal electrodes 117, which are disposed at both ends of the nonconductive member 111 to electrically connect each of the sealing electrodes 130 to the surge absorbing unit 110.

The nonconductive member 111 may have a cylindrical alumina rod shape. The conductive coating film 113 is used as a discharge electrode and may be formed of a metal with high electrical conductivity such as nickel (Ni) or titanium (Ti).

In addition, referring to FIG. 1B, a surge absorbing unit 110*a* according to the present invention includes a nonconductive member 111, a conductive coating film 113 formed to enclose the nonconductive member 111, a protective film 114 that protects the conductive coating film 113 in a state of enclosing the conductive coating film 113, a plurality of discharge gaps 115*a* and 115*b* that divide the conductive coating film 113 and the protective film 114, and terminal electrodes 117 that are disposed at both ends of the nonconductive member 111 to electrically connect the sealing electrode 130 to the surge absorbing unit 110*a*. As such, the surge absorbing unit according to the present invention may be formed in various shapes, taking into consideration use and characteristics of products.

In this regard, the protective film 114 may be a conductive ceramic thin film that surrounds exposed portions of the conductive coating film to prevent discharge energy generated during discharge of gas from being transferred to the conductive coating film 113.

The protective film 114 may be formed of a conductive ceramic material having strong covalent binding affinity such as conductive oxides, conductive nitrides, conductive carbides, conductive fluorides, and conductive silicides.

The ceramic tube 120 according to the present invention has a cylindrical shape and is formed of a ceramic material. The cylindrical ceramic tube 120 is provided with the sealing electrodes 130 at both ends. An inert gas is filled in the ceramic tube 120 sealed by the sealing electrodes 130. In addition, both ends of the ceramic tube 120 are joined to the sealing electrodes 130 by brazing junctions.

The sealing electrodes 130 are installed at both ends of the ceramic tube 120 as described above to be respectively electrically connected to the lead wires 170.

In addition, for example, the sealing electrodes 130 may be formed of a copper alloy.

For example, each of the sealing electrodes 130 may include a contact portion 133 that protrudes toward the inside of the ceramic tube 120 to be inserted into the ceramic tube 120 and contact the surge absorbing unit 110—and a junction portion 131 joined to the brazing ring 150.

Since the contact portion 133 of the sealing electrode 130 protrudes inward, the sealing electrode 130 may be efficiently assembled with the brazing ring 150 or the ceramic tube 120. Since the surge absorbing unit 110 contained in the ceramic tube 120 may be pressed during a brazing process, electrical connection between the sealing electrode 130 and the contact portion 133 may be improved.

The brazing ring 150 according to the present invention, as a filler metal, is melted between the ceramic tube 120 and each of the sealing electrodes 130 which are base metals to join the ceramic tube 120 to the sealing electrodes 130 in a sealed state.

For example, the brazing ring 150 may be formed of an alloy including copper (Cu), silver (Ag), and zinc (Zn).

In addition, the brazing process is performed at a temperature higher than a melting point of the brazing ring 150, as a filler metal, and lower than melting points of the ceramic tube 120 and the sealing electrodes 130, as base metals.

Wetting properties that indicate the degree of affinity between a filler metal and a base metal are an important factor in a brazing junction. That is, when the brazing ring has poor wetting properties with the ceramic tube 120 and the sealing electrodes 130, a junction therebetween cannot be formed. Thus, according to the present invention, a ceramic material having excellent wetting properties with the filler metal is used to form the ceramic tube 120 that accommodates the surge absorbing unit 110 instead of a glass material having poor wetting properties with the filler metal.

In addition, the brazing junction using the brazing ring 150 may provide high joining strength since the brazing ring 150 generates capillary action on the surfaces of the ceramic tube 120 and the sealing electrodes 130 while being melted. In addition, the inside of the ceramic tube 120 may be completely sealed by joining by use of the brazing ring 150 providing excellent resistance against impact such as vibration or the like.

Meanwhile, an outer surface 151 of the brazing ring 150 is disposed at the same level of an outer surface of the ceramic tube 120, and an inner surface 152 of the brazing ring 150 is disposed to extend toward the inside of the ceramic tube 120 to a portion farther inward than an inner edge of the ceramic tube 120. As a result, sealing efficiency may be improved.

As described above, the surge absorber 100 according to the present invention may have improved durability and the ceramic tube 120 may be completely sealed since the ceramic tube 120 formed of a ceramic material with excellent mechanical strength is used instead of a conventional glass tube and the ceramic tube 120 is joined to each of the sealing electrodes 130 by use of the brazing rings 150. In addition, as durability of the surge absorber 100 increases, the surge absorber 100 may be stably used at a high voltage.

Figure 4:
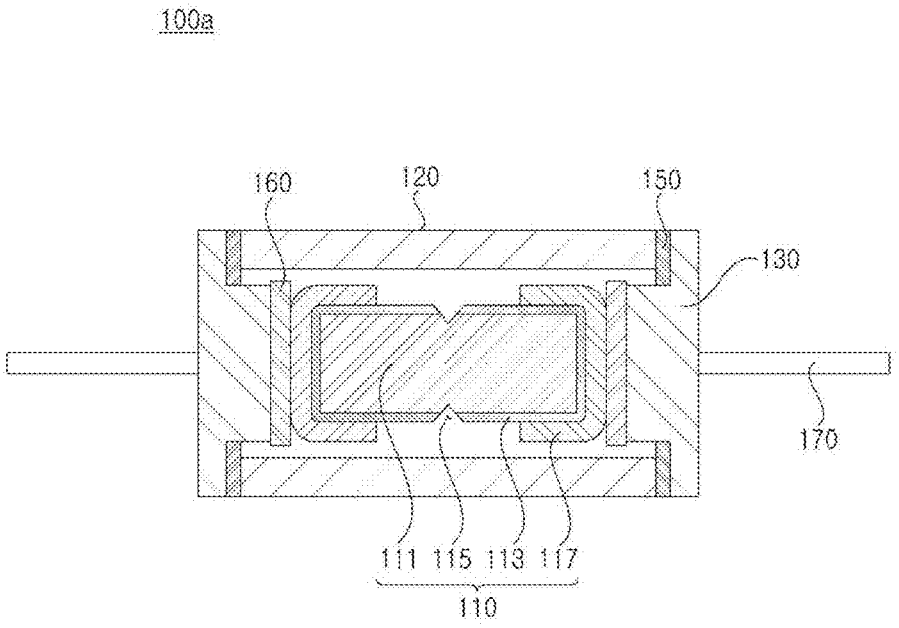
FIG. 4 is a sectional view illustrating a surge absorber according to a second embodiment of the present invention.

FIG. 4 is a sectional view illustrating a surge absorber 100*a* according to a second embodiment of the present invention.

Referring to FIG. 4, the surge absorber 100*a* according to the present invention may further include brazing members 160 that join each of the contact portions 133 to each of the terminal electrodes 117.

For example, the brazing member 160 may have a plate shape and may be formed of an alloy including copper (Cu), silver (Ag), and zinc (Zn).

The brazing member 160 is melted between the contact portion 133 and the terminal electrode 117 to join the contact portion 133 to the terminal electrode 117 in the same manner as the brazing ring 150.

Thus, the surge absorbing unit 110 may be more firmly joined to the sealing electrodes 130 by use of the brazing members 160, thereby improving durability of the surge absorber 100*a*.

Figure 5:
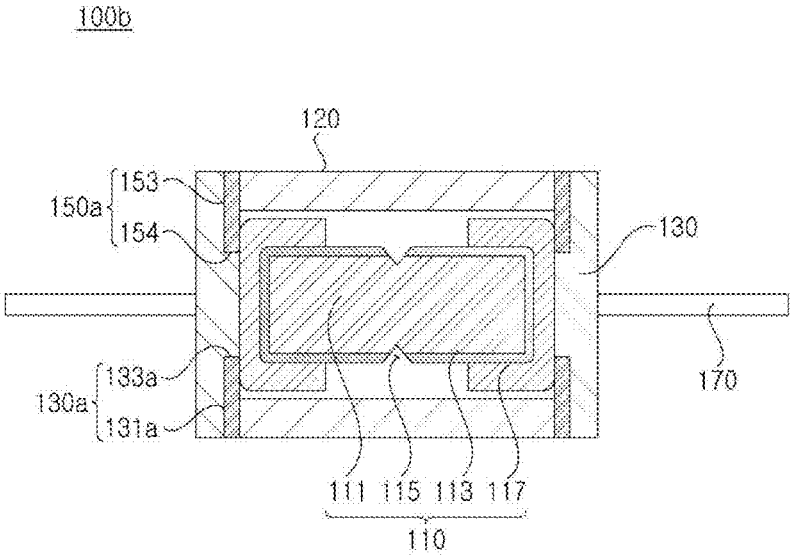
FIG. 5 is a sectional view illustrating a surge absorber according to a third embodiment of the present invention.

FIG. 5 is a sectional view illustrating a surge absorber 100*b* according to a third embodiment of the present invention.

Referring to FIG. 5, each of the brazing rings 150*a* of the surge absorber 100*b* according to the present invention may be configured to be joined to both of the ceramic tube 120 and the surge absorbing unit 110.

That is, the brazing ring 150*a* may include an outer portion 153 that is joined to an end of the ceramic tube 120 and an inner portion 154 that is joined to an end portion of the surge absorbing unit 110, particularly, the terminal electrode 117.

Thus, the brazing ring 150*a* may have a thickness identical to or greater than that of the contact portion 133*a*. This is because, when the thickness of the brazing ring 150*a* is greater than that of the contact portion 133*a*, the brazing ring 150*a* may be joined to both the ceramic tube 120 and the terminal electrode 117 after being melted.

In addition, the inner portion 154 of the brazing ring 150*a* may be formed to extend inward to a portion farther inward than that of the brazing ring 150 of FIG. 2, and the contact portion 133*a* may have a narrower width than the contact portion 133 of FIG. 2.

Figure 6:
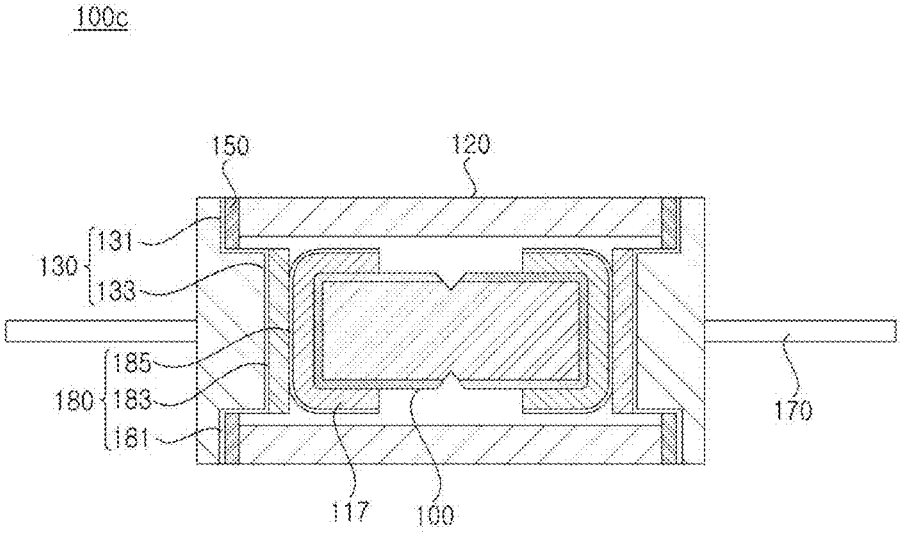
FIG. 6 is a sectional view illustrating a surge absorber according to a fourth embodiment of the present invention.

FIG. 6 is a sectional view illustrating a surge absorber 100*c* according to a fourth embodiment of the present invention.

Referring to FIG. 6, the surge absorber 100*c* according to the present invention may further include a plating layer 180 in order to improve wetting properties of the brazing ring 150 or the brazing member 160 with base metals.

In particular, the plating layer 180 (181, 183, and 185) is formed on at least one of the contact portion 133, the junction portion 131, and the terminal electrode 117 to improve joining strength of the brazing ring 150 or the brazing member 160 and to improve discharge properties by a melting process.

In addition, the plating layer 180 may include nickel (Ni) or titanium (Ti), and may be formed of, for example, a compound such as $Ni_3P$.

Figure 7A:
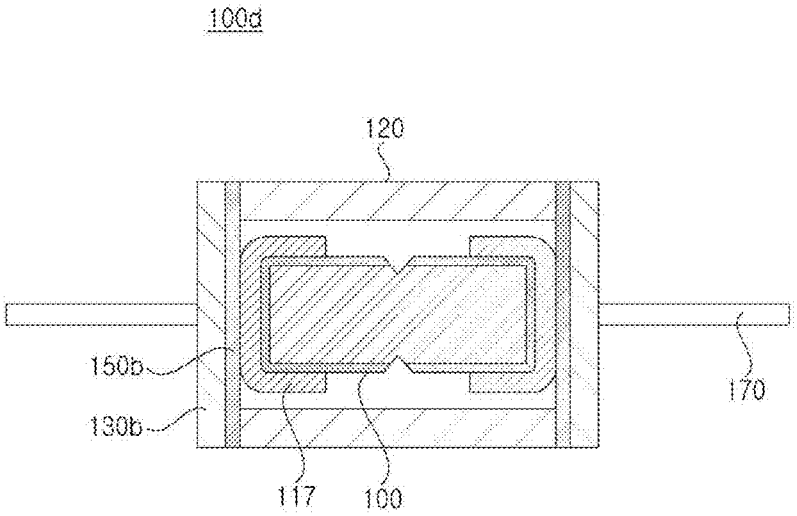
FIGS. 7A and 7B are sectional views illustrating a surge absorber according to a fifth embodiment of the present invention.
Figure 7B:
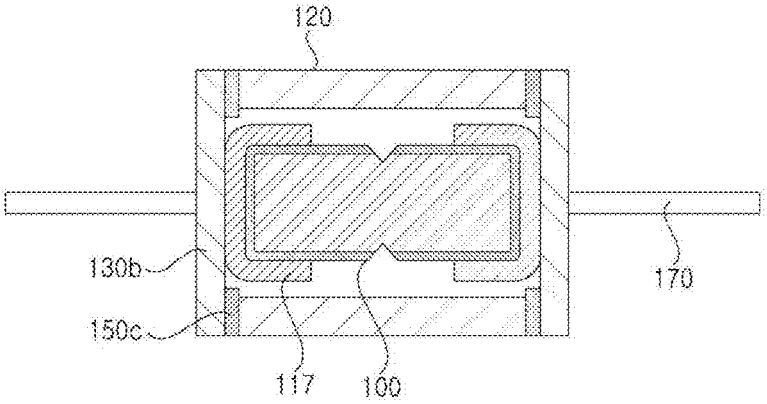

FIGS. 7A and 7B are sectional views illustrating a surge absorber 100*d* according to a fifth embodiment of the present invention.

Referring to FIGS. 7A and 7B, each of the sealing electrodes 130*b* according to the present invention may have a flat panel shape without having a protruding contact portion which is different from the sealing electrodes illustrated in FIGS. 1 to 6.

In addition, a brazing ring 150*b* may have a flat panel shape so as to be joined to one end of the ceramic tube 120 and one terminal electrode 117 at the same time (FIG. 7A).

In addition, a brazing ring 150*c* may have a hollow ring shape such that the sealing electrode 130 directly contacts the terminal electrode 117 (FIG. 7B).

Hereinafter, a method of manufacturing a surge absorber according to the present invention will be described in detail.

FIGS. 8A to 8F are sectional views for describing a method of manufacturing a surge absorber 100 according an embodiment of the present invention.

As described above, the surge absorber 100 manufactured by the method according to the present invention may include a ceramic tube 120 in which a surge absorbing unit 110 is accommodated, first and second sealing electrodes 130 and 135 respectively inserted into both ends of the ceramic tube 120 to be connected to the surge absorbing unit 110, and first and second brazing rings 150 and 155 respectively joining the ceramic tube 120 to each of the first and second sealing electrodes 130 and 135.

Figure 8A:
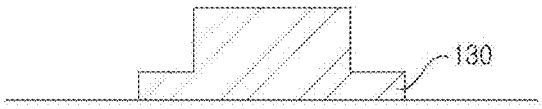
FIGS. 8A to 8F are sectional views for describing a method of manufacturing a surge absorber according an embodiment of the present invention.

First, referring to FIG. 8A, the first sealing electrode 130 is formed in operation S1. The first sealing electrode 130 includes a contact portion 133 that protrudes toward the inside of the ceramic tube 120 to be inserted into the ceramic tube 120 and contact to the surge absorbing unit 110 and a junction portion 131 joined to the first brazing ring 150.

Figure 8B:
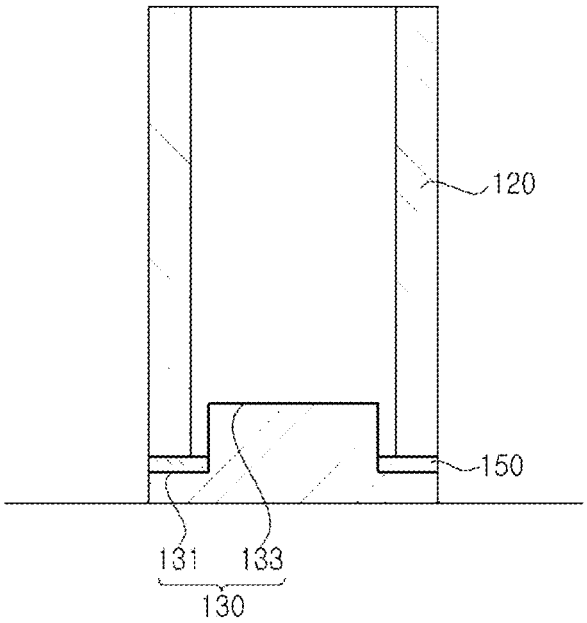

Then, referring to FIG. 8B, the first brazing ring 150 and the ceramic tube 120 are sequentially stacked on the first sealing electrode 130 in operation S2.

The first brazing ring 150 is mounted on the junction portion 131 of the first sealing electrode 130, and the ceramic tube 120 is disposed on the first brazing ring 150.

Figure 8C:
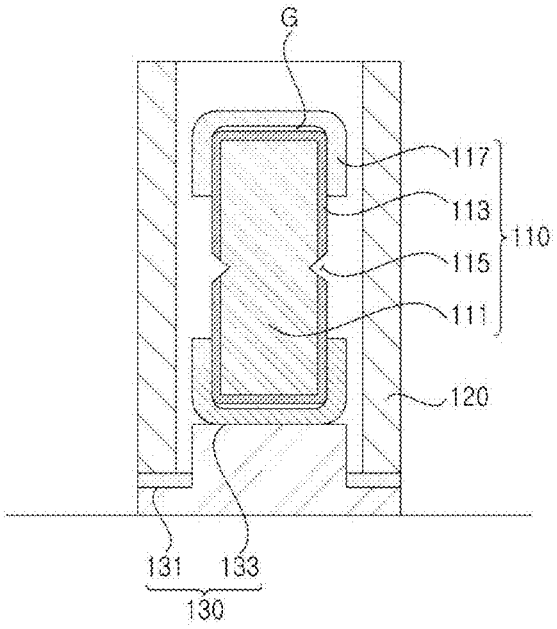

Then, referring to FIG. 8C, the surge absorbing unit 110 is inserted into the ceramic tube 120 in operation S3.

In this regard, the surge absorbing unit 110 may include a nonconductive member 111, a conductive coating film 113 enclosing the nonconductive member 111, discharge gaps 115 dividing the conductive coating film 113 at the center thereof allowing the conductive coating film 113 to be used as discharge electrodes, and first and second terminal electrodes 117 and 117*a* disposed at both ends of the nonconductive member 111 to electrically connect each of the first and second sealing electrodes 130 and 135 with the surge absorbing unit 110.

The first terminal electrode 117 of the inserted surge absorbing unit 110 is disposed on an upper surface of the contact portion 133 of the first sealing electrode 130. A gap G or space may be formed between an inner surface of the first terminal electrode 117 and the conductive coating film 113. The gap G or space may be eliminated by pressure applied thereto when the second sealing electrode 135 is joined to the first terminal electrode 117 which will be described later and by a brazing process described in operation S5. The gap G or space may be naturally or artificially formed during the assembly of the surge absorbing unit 110.

Figure 8D:
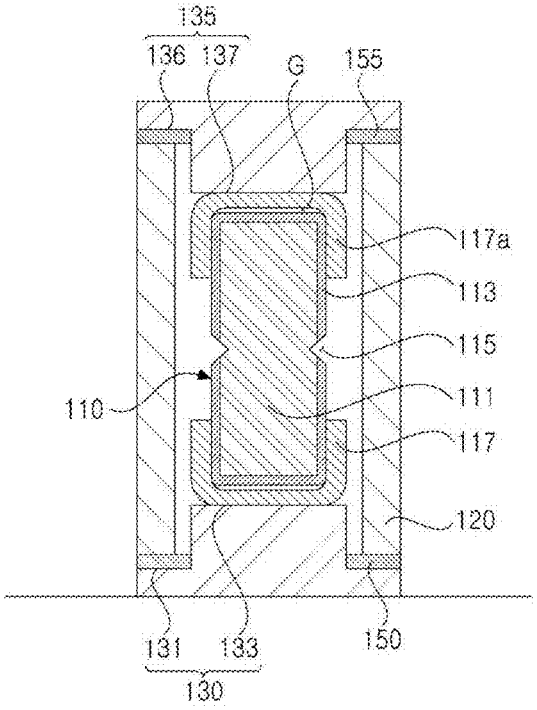

Then, referring to FIG. 8D, the second brazing ring 155 and the second sealing electrode 135 are sequentially stacked on the ceramic tube 120 in operation S4.

The surge absorber 100 is assembled through operation S1 to operation S4 to be a state before the brazing junction.

Then, the surge absorber 100 that has undergone operation S1 to operation S4 is placed in a chamber C under an inert gas atmosphere, and the ceramic tube 120 and each of the first and second sealing electrodes 130 and 135 are sealed by melting the first and second brazing rings 150 and 155 in operation S5.

Figure 8E:
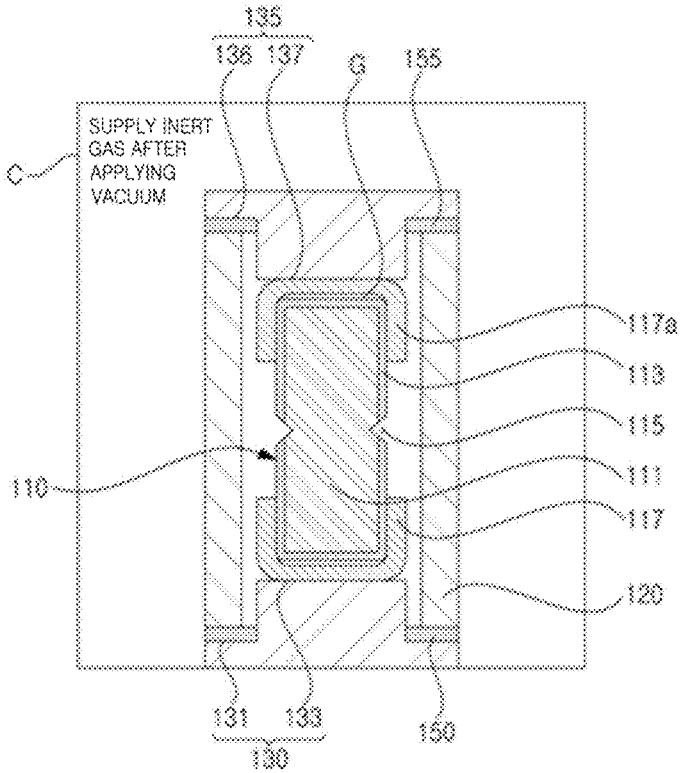

Referring to FIG. 8E, the surge absorber 100 that is not in a sealed state is vertically added to the chamber C in a state of standing in a longitudinal direction. Then, the inside of the chamber C is brought into a vacuum state to remove air therefrom, and then an inert gas is supplied to the chamber C.

In this regard, since the surge absorber 100 is not sealed, the inert gas enters the ceramic tube 120.

Figure 8F:
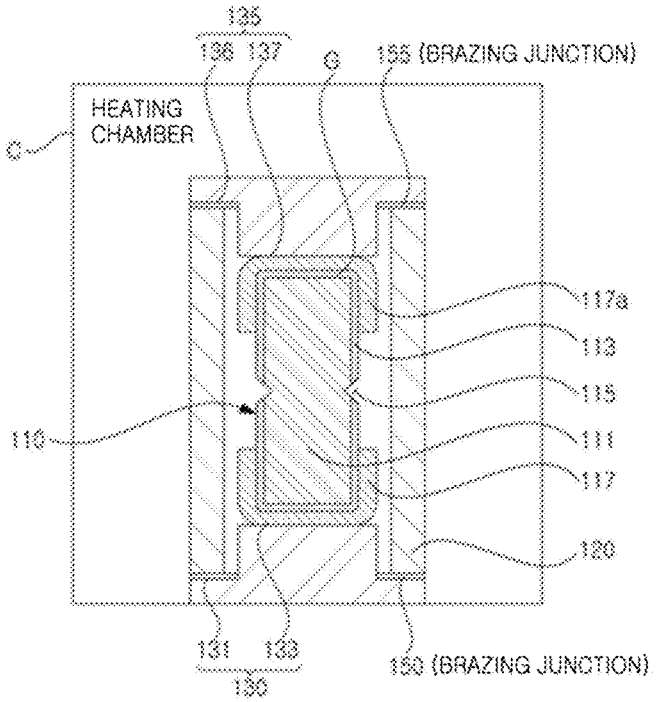

Referring to FIG. 8F, the chamber C is heated to melt the first and second brazing rings 150 and 155, thereby sealing the surge absorber 100. In this regard, the chamber C is heated at a temperature less than melting points of the first and second sealing electrodes 130 and 135 and the ceramic tube 120 which are base metals in order to prevent deformation of the base metals. The heating temperature may be adjusted in the range of 500 to 850° C. according to the material of the first and second brazing rings 150 and 155. For example, when the first and second brazing rings 150 and 155 are formed of an alloy including copper (Cu) and silver (Ag), e.g., $Ag_{25}Cu$, the chamber C is heated at a temperature of 800 to 850° C. When the first and second brazing rings 150 and 155 are formed of an alloy including silver (Ag), copper (Cu), and zinc (Zn), e.g., $Ag_{56}CuZn$, the chamber C is heated at a temperature of 600 to 650° C.

Then, the heated first and second brazing rings 150 and 155 are melted to join the surfaces of the base metals in a sealed state through capillary action, thereby decreasing in thickness. Then, lead wires are connected to outer surfaces of the sealing electrodes, thereby completing manufacture of the surge absorber 100.

Figure 9:
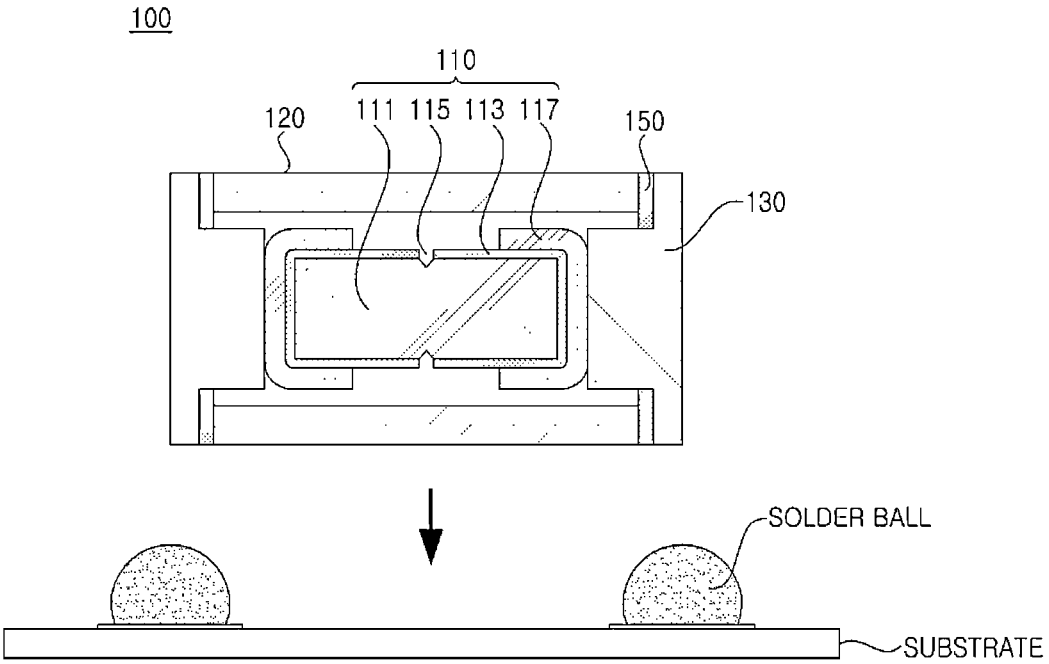
FIG. 9 is a sectional view illustrating a surge absorber according to the present invention mounted on a surface of a substrate.
Figure 9:
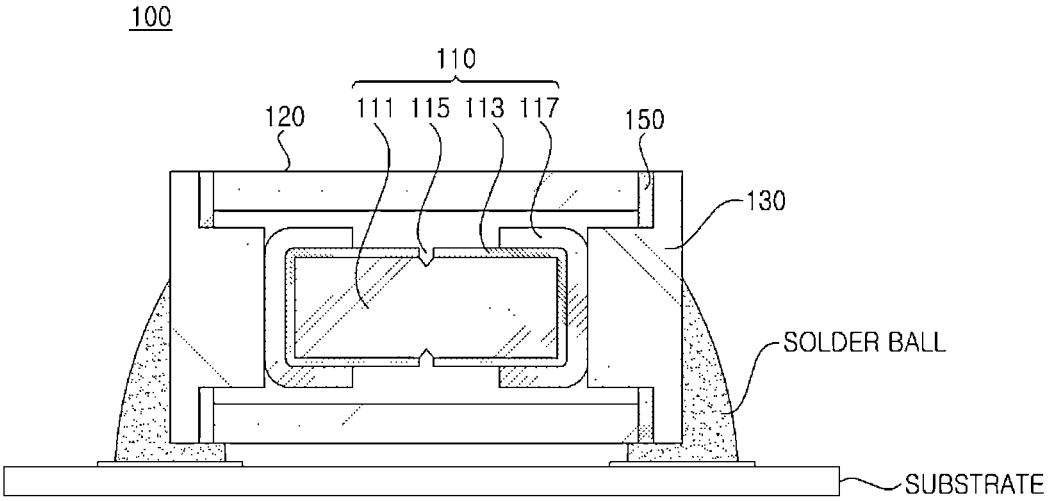
Figure 10:
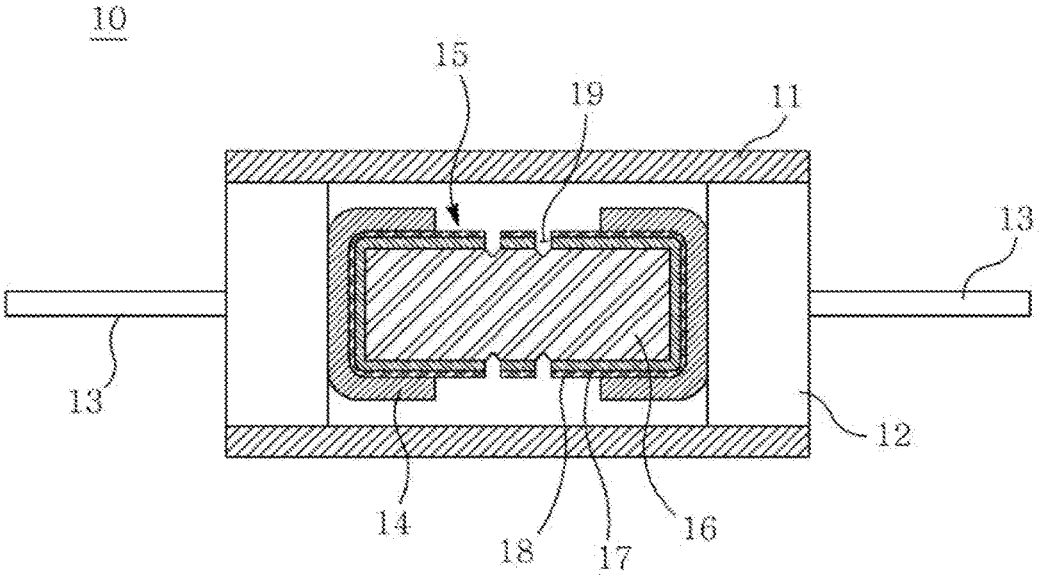
FIG. 10 (PRIOR ART)
FIG. 10 is a sectional view illustrating a structure of a conventional surge absorber.

FIG. 9 is a sectional view illustrating a surge absorber 100*a* according to the present invention mounted on a surface of a substrate.

Referring to FIG. 9, lead wires may be omitted, and the sealing electrodes 130 may be joined to solder balls in the surge absorber 100*a* according to the present invention. Thus, the surge absorber 100*a* may be used as a surface mount device (SMD).

As described above, according to the method of manufacturing the surge absorber, a ceramic material with excellent mechanical strength is used to form the ceramic tube, and the ceramic tube is joined to the sealing electrodes by use of the brazing rings, and thus joining strength and durability of the surge absorber are improved.

As described above, according to the method of manufacturing the surge absorber, a ceramic material with excellent mechanical strength is used to form the ceramic tube, and the ceramic tube is joined to the sealing electrodes by use of the brazing rings, and thus durability of the surge absorber may be improved, and the inside of the ceramic tube may be completely sealed. As a result, according to the method of manufacturing the surge absorber according to the present invention, the ceramic tube completely sealed and durability is improved, and thus the surge absorber stably may be used at a high voltage.

As apparent from the above description, since a ceramic material with excellent mechanical strength is used to form the ceramic tube and the ceramic tube is joined to the sealing electrodes by use of the brazing ring, the surge absorber according to the present invention may have excellent durability and the inside of the ceramic tube may be completely sealed.

According to the present invention, the surge absorber may be stably used at a high voltage due to improved sealing performance and durability.

In addition, according to the present invention, since a plating layer is formed at brazing junction regions, wetting properties, joining strength, and discharge performance of the brazing ring may be improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A surge absorber comprising:

a ceramic tube filled with an inert gas, the ceramic tube having a left end and a right end;

a left sealing electrode disposed at the left end of the ceramic tube and connected to a left lead wire, a right sealing electrode disposed at the right end of the ceramic tube and connected to a right lead wire, a surge absorbing unit located inside the ceramic tube, having a left section electrically connected to the left sealing electrode, having a right section electrically connected to the right sealing electrode, and having at least one discharge gap;

a left brazing ring brazed between the left end of the ceramic tube and the left sealing electrode; and a right brazing ring brazed between the right end of the ceramic tube and the right sealing electrode, wherein the left sealing electrode comprises a left contact portion protruding toward the inside of the ceramic tube and contacting, directly or indirectly, the left section of the surge absorbing unit, and further comprises a left junction portion joined to the left brazing ring, wherein the left contact portion has a solid cylinder shape, and wherein the right sealing electrode comprises a right contact portion protruding toward the inside of the ceramic tube and contacting, directly or indirectly, the right section of the surge absorbing unit, and further comprises a right junction portion joined to the right brazing ring, wherein the right contact portion has a solid cylinder shape.

2. The surge absorber according to claim 1, wherein the left and right brazing rings each comprise an alloy comprising copper (Cu), silver (Ag), and zinc (Zn).

3. The surge absorber according to claim 1, wherein an outer surface of the left brazing ring is disposed at a same level of an outer surface of the ceramic tube, and an inner surface of the left brazing ring is disposed to extend toward the inside of the ceramic tube to a portion farther inward than an inner edge of the ceramic tube.

4. The surge absorber according to claim 3, wherein the left brazing ring comprises an outer portion brazed to the left end of the ceramic tube and an inner portion brazed to the left section of the surge absorbing unit, and wherein the right brazing ring comprises an outer portion brazed to the right end of the ceramic tube and an inner portion brazed to the right section of the surge absorbing unit.

5. The surge absorber according to claim 1, further comprising a left brazing member melted between the left contact portion of the left sealing electrode and the left section of the surge absorbing unit, and a right brazing member melted between the right contact portion of the right sealing electrode and the right section of the surge absorbing unit.

6. The surge absorber according to claim 5, further comprising a plating layer comprising nickel (Ni) or titanium (Ti) disposed on at least one of the contact portions, the junction portions, and the terminal electrodes to improve joining strength and discharge properties by melting of at least one of the brazing rings or the brazing members.

7. A method of manufacturing a surge absorber comprising a ceramic tube accommodating a surge absorbing unit, first and second sealing electrodes respectively inserted into both ends of the ceramic tube to be joined to the surge absorbing unit, and first and second brazing rings respectively joining the ceramic tube to each of the first and second sealing electrodes, the method comprising:

preparing the first sealing electrode;

sequentially stacking the first brazing ring and the ceramic tube on the first sealing electrode;

inserting the surge absorbing unit into the ceramic tube;

sequentially stacking the second brazing ring and the second sealing electrode on the ceramic tube; and sealing between the ceramic tube and each of the first and second sealing electrodes by placing a resultant structure in a chamber under an inert gas atmosphere and melting the first and second brazing rings, and wherein the first sealing electrode comprises a left contact portion protruding toward the inside of the ceramic tube and contacting, directly or indirectly, a left section of the surge absorbing unit, and further comprises a left junction portion joined to the first brazing ring, wherein the left contact portion has a solid cylinder shape, and wherein the second sealing electrode comprises a right contact portion protruding toward the inside of the ceramic tube and contacting, directly or indirectly, a right section of the surge absorbing unit, and further comprises a right junction portion joined to the second brazing ring, wherein the right contact portion has a solid cylinder shape.

8. The method according to claim 7, wherein:

each of the first and second brazing rings is inserted to the junction portion of each of the first and second sealing electrodes.

9. The method according to claim 7, wherein:

the first and second brazing rings are formed of $Ag_{25}Cu$, an alloy having a surface provided with copper (Cu) and silver (Ag); and the sealing is performed by melting the first and second brazing rings at a temperature of 800 to 850 degrees Celsius.

10. The method according to claim 7, wherein:

the first and second brazing rings are formed of $Ag_{56}CuZnSn$, an alloy comprising silver (Ag), copper (Cu), zinc (Zn), and tin (Sn); and the sealing is performed by melting the first and second brazing rings at a temperature of 600 to 650 degrees Celsius.

11. The method according to claim 8, wherein a plating layer comprising nickel (Ni) or titanium (Ti) is further disposed on a surface of the junction portion to improve joining strength and discharge performance by melting of the first and second brazing rings.

* * * * *